United States Patent [19]

Fornasari

[11] Patent Number: 4,754,770

[45] Date of Patent: Jul. 5, 1988

[54] DISHWASHER EQUIPPED WITH A SINGLE, UNIDIRECTIONAL ELECTRIC MOTOR FOR WASHING AND DRAIN CYCLES

[75] Inventor: Paolo Fornasari, Casale Monferrato, Italy

[73] Assignee: eltek S.p.A., Casale Monferrato, Italy

[21] Appl. No.: 866,075

[22] Filed: May 22, 1986

[30] Foreign Application Priority Data

Jun. 21, 1985 [IT] Italy ..... 67579 A/85

[51] Int. Cl.[4] ..... B08B 3/02

[52] U.S. Cl. ..... 134/57 D; 134/186; 134/195; 137/567; 137/625.44

[58] Field of Search ..... 134/56 D, 57 D, 174, 134/175, 176, 186, 187, 188, 191, 193, 195; 137/567, 625.44; 68/208

[56] References Cited

U.S. PATENT DOCUMENTS

| | | | |
|---|---|---|---|
| 3,078,858 | 2/1963 | Jacobs et al. | 134/188 X |
| 3,144,759 | 8/1964 | Bochan | 68/208 X |
| 3,810,480 | 5/1974 | Smith et al. | 134/188 X |
| 4,130,265 | 12/1978 | Sakakibara et al. | 137/625.44 X |

FOREIGN PATENT DOCUMENTS

| | | | |
|---|---|---|---|
| 248128 | 11/1963 | Australia | 137/625.44 |

*Primary Examiner*—Philip R. Coe

*Attorney, Agent, or Firm*—Browdy and Neimark

[57] ABSTRACT

This invention relates to a dishwasher equipped with a single, unidirectional electric motor driving two impellers coaxial to a pump which sends water to a bypass valve containing inlets and outlets. The opening and closing of inlets and outlets is controlled by an actuator thermally activated by a heater/controller. Power is supplied to the controller through leads connected to a timer.

5 Claims, 1 Drawing Sheet

Fig.1
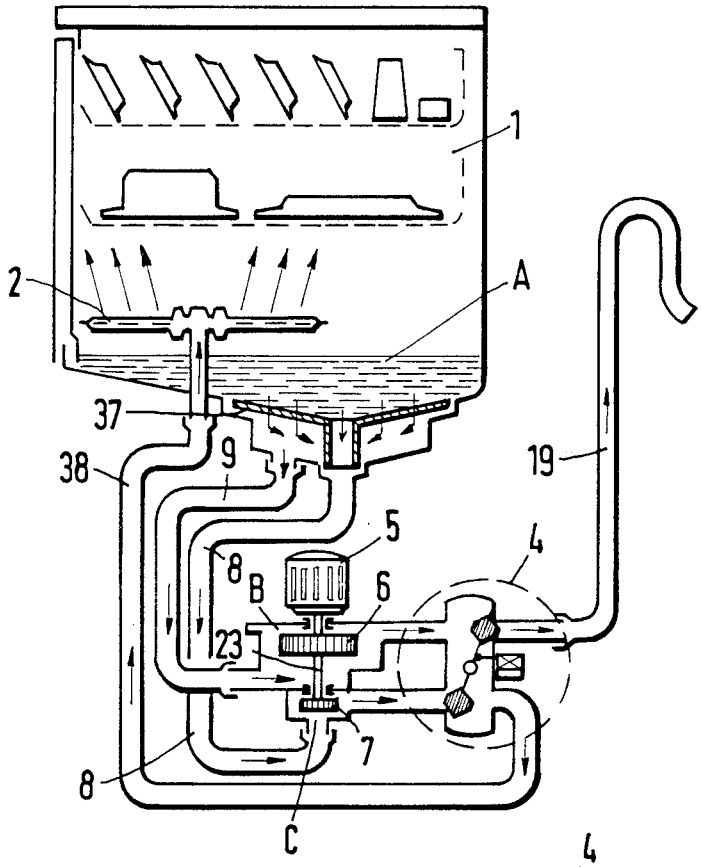
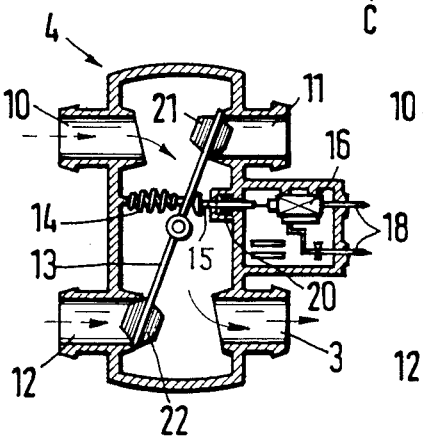
Fig.2
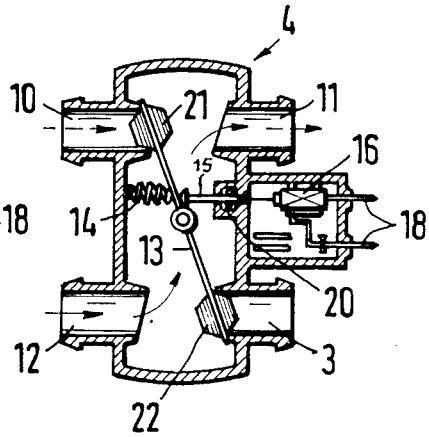
Fig.3

DISHWASHER EQUIPPED WITH A SINGLE, UNIDIRECTIONAL ELECTRIC MOTOR FOR WASHING AND DRAIN CYCLES

DESCRIPTION

Currently available dishwashers use two electric motors. One is connected to the wash cycle pump; a second pump, having less power than the first, is connected to the drain pump. The motor-drain pump assembly is costly and has a significant effect on the overall price of the dishwasher.

There are dishwashers having a single motor connected to a pump for both the wash and drain water. These machines are usually equipped with an reversing electric motor. One direction of rotation corresponds to the wash cycle, while the opposite direction of rotation is used to drain the water. In these machines, the same water circuit is used for pumping wash water and for draining waste water. This system leads to the mixing of the wash and drain water. For this reason, dishwashers currently use two motors and two separate circuits for the wash and drain cycles.

The present invention relates to a dishwasher equipped with a single, unidirectional electric motor and two separate water circuits. One circuit is used to pump wash water to the spray arms, while the second circuit is used to pump water used during the wash cycle out of the machine. The invention has excellent functional characteristics with lowered production costs due to the fact it has but a single, unidirectional electric motor.

The invention comprises a single, unidirectional electric motor. Two impellers, located in two separate housings, are mounted on a shaft. The impeller housings are connected to a bypass valve which opens or closes either the circuit used to pump water to the spray arms or the drain circuit. Said bypass valve contains a shut-off mechanism with two positions controlling the flow of water through the valve.

The position of the shut-off valve is controlled by a rod contained in an actuator thermally activated by a heater/controller. The valve also contains a return spring for the shut-off valve.

The invention will be described further, by way of example, with reference to the accompanying drawings, in which:

FIG. 1 is a schematic drawing of the main parts of a dishwasher as described.

FIGS. 2 and 3 show, on a greater scale, the two positions of the bypass valve.

With reference to FIGS. 1, 2 and 3, a pre-established volume of water "A", controlled by a cycle timer, enters the dishwasher. The water is then pumped through spray arms 2, which rotate owing to the water pressure and spray water under and over the racks 1. The spray arms 2 are connected to union 3 of bypass valve 4 with hose 38. A unidirectional electric motor 5 drives impellers 6 and 7 connected to shaft 23. Hose 8 also connects the dishwasher tub with housing C containing impeller 7. Another hose 9 connects the tub of the dishwasher with housing B containing impeller 6. Housings B and C are connected to the bypass valve at unions 10 and 12 (FIGS. 2 and 3). A drain hose 19 is connected to the bypass valve at union 11.

The bypass valve 4 comprises a hollow chamber containing a rocker lever 13 held in the position shown in FIG. 2 by a spring 14. A rod 15, placed opposite a spring, is controlled axially by an actuator 16 thermally activated by a heater/controller. Power for heating is supplied to the controller by leads going from the cycle timer to connectors 18. Said rod 15 slides back and forth through seal 20. Truncated biconical plugs 21 and 22, located on both ends of a rocker lever 13, shut openings 11 and 12 (FIG. 2) or 10 and 3 (FIG. 3).

The actuator 16 comprises a hermetically sealed metal casing containing the rod 15 and wax having high thermal dilative properties. The controller activates said actuator and is connected to the cycle timer at connectors 18. When the actuator 16 is not activated, rod 15 is retracted as shown in FIG. 2. Said actuator is activated as shown in FIG. 3, when the controller is energized. As a result of the heat generated by the controller, the wax dilates or expands forcing the rod 15 out from the casing of the actuator 16.

When the washing cycle of the dishwater is selected by the timer, the bypass valve shut-off mechanism 13 is in the position shown in FIGS. 1 and 2. In this case, the water "A" present in the tub of the dishwasher 1 goes down through hose 9 to the wash cycle impeller 6 where it is pumped to the bypass valve 4. The shut-off mechanism 13 closes ports 11 and 12 and opens inlet 10 and outlet 3. The water then goes through hose 38 to the spray arms 2, which rotate and spray water during the pre-wash or wash cycles.

When the timer selects the drain cycle, the controller is energized, thereby activating the actuator 16 thermally. Rod 15 goes from the position shown in FIG. 2 to that shown in FIG. 3. The shut-off mechanism 13 is pressed against spring 14 until plugs 21 and 22 open inlet 12 and outlet 11, and at the same time openings 10 and 3 are shut off. The water "A" goes down through hose 8 to drain cycle impeller 7. The water is pumped from impeller housing "C" to the bypass valve 4 and then out of the drain hose 19.

Actuator 6 is activated by the heater/controller in approximately ten to twenty seconds. This is compatible with the timer which requires 60 to 120 seconds to select the next phase.

The present invention is not limited to those versions described. It also includes other devices which comprise a bypass flow valve governed by an actuator thermally activated by a posistor.

I claim:

1. A dishwasher comprising a single, undirectional electric motor for washing and drain cycles, two impellers mounted coaxially on a shaft of said motor for rotation in two separate housings directly connected to a hollow chamber containing four openings arranged symmetrically on opposite sides of said chamber; two of said openings being water outlets, one of which is connected to a drain hose and the other to dishwasher spray arms, the other two openings being water inlets communication respectively with said housings, a bypass valve in said chamber containing a rocker lever with plugs on both ends that can shut off two openings on diagonally opposite sides of said bypass valve, one being a water inlet and one being a water outlet; said rocker lever being a mobile shut-off mechanism maintained in either a first position with one inlet and one outlet closed or a second position with the other inlet and other outlet closed by a spring, and an actuator comprising a rod partially immersed in a hermetically sealed casing containing wax having high thermal dilative properties, said actuator being connected to a heater/controller powered by a cycle timer.

2. A dishwasher as claimed in claim 1, in which the wash water is conveyed to a said impeller through a hose and is pumped to said bypass valve and then to said spray arms, which are activated by the water pressure; the drain water is conveyed to said other impeller through a hose, is pumped to said bypass valve, and then to a drain hose; and there are two separate water circuits to avoid mixing.

3. A dishwasher as claimed in claim 1, in which said bypass valve mechanism is contained in the same housing as one or both of the coaxially mounted, unidirectional impellers.

4. A water flow control system for a dishwasher comprising:

a single, unidirectional electric motor, said motor comprising a drive shaft with a first impeller and a second impeller mounted on said drive shaft;

a first housing about said first impeller and a second housing about said second impeller;

a valve chamber containing four openings arranged symmetrically on opposite sides thereof, said four openings comprising a first inlet opening in communication with said first housing, a second inlet opening in communication with said second housing, a third outlet opening and a fourth outlet opening, said first inlet opening and said fourth outlet opening being spaced opposite one another with said second inlet opening and said third outlet opening being spaced opposite one another such that when said first and third openings are closed are second and fourth openings are open and form a flow path through said hollow chamber, and when said second and fourth openings are closed said first and third openings are open and form a flow path through said hollow chamber;

first water communication means for receiving water from a dishwashing tub and passing it to said first impeller housing; second water communication means for receiving water from a dishwasher tub and passing such water to said second impeller housing; third water communication means for passing water from said third outlet opening to a dishwashing spray mechanism; fourth water communication means for passing water from said fourth outlet opening to a discharge drain; and a bypass valve in said hollow chamber, said bypass valve including a rocker lever with plugs on both ends for shutting off two of said four openings at a time on diagonally opposite sides of said bypass valve, whereby said rocker lever in a first position closes said second inlet and fourth outlet while leaving open said first inlet and third outlet, and in a second position closes said first inlet and third outlet while leaving open said second inlet and fourth outlet, said bypass valve further comprising a spring means biasing said rocker lever in said first position with said first inlet and third outlet open, and an actuator having a control rod positioned generally opposite said spring and powered by control means to move said valve to said second position opposite the force of said spring means, said control means being powered by a cycle timer.

5. A device according to claim 4, wherein said actuator comprises a hermetically sealed casing containing wax having high thermal dilative properties into which said rod is partially immersed, and said control means comprises a heater/controller for heating said wax to cause dilation thereof and the axial movement of said rod against force of said spring.

* * * * *